United States Patent [19]

Ookubo

[11] Patent Number: 4,710,046

[45] Date of Patent: Dec. 1, 1987

[54] PLATEN CLUTCH MECHANISM

[75] Inventor: Hiroaki Ookubo, Kurume, Japan

[73] Assignee: Matsushita Electric Industrial Co. Ltd., Osaka, Japan

[21] Appl. No.: 753,565

[22] Filed: Jul. 10, 1985

[30] Foreign Application Priority Data

Jul. 10, 1984 [JP] Japan ..... 59-142726

[51] Int. Cl.[4] ..... B41J 19/96; B41J 11/24

[52] U.S. Cl. ..... 400/556.2; 400/559.1

[58] Field of Search ..... 400/564, 556, 556.1, 400/569, 559, 559.1, 556.2, 556.4

[56] References Cited

U.S. PATENT DOCUMENTS

| | | | |
|---|---|---|---|
| 1,021,386 | 3/1912 | Uhlig | 400/556.1 |
| 1,021,970 | 4/1912 | Corcoran | 400/556.1 |
| 1,096,791 | 5/1914 | Mohler | 400/556.1 |
| 3,655,023 | 4/1972 | Stanevich | 400/556.1 |
| 4,247,212 | 1/1981 | Wu | 400/559.1 X |

FOREIGN PATENT DOCUMENTS

| | | | |
|---|---|---|---|
| 348775 | 2/1922 | Fed. Rep. of Germany | 400/556 |
| 459207 | 4/1928 | Fed. Rep. of Germany | 400/556 |
| 505898 | 8/1930 | Fed. Rep. of Germany | 400/556 |
| 2428944 | 1/1976 | Fed. Rep. of Germany | 400/556 |
| 143232 | 8/1980 | Fed. Rep. of Germany | 400/556 |

*Primary Examiner*—Edgar S. Burr
*Assistant Examiner*—James R. McDaniel
*Attorney, Agent, or Firm*—Wenderoth, Lind & Ponack

[57] ABSTRACT

A printer having a platen mounted on a shaft rotatably and a line indexing driving gear with a releasable clutch mechanism which couples selectively the platen and driving gear for line-by-line indexing or manual indexing of the platen.

The clutch mechanism includes a first clutch means fixed on the shaft and a second clutch means which is moveable along the shaft with a knob.

The driving gear mounted on the shaft rotatably engages with the second clutch.

2 Claims, 4 Drawing Figures

PLATEN CLUTCH MECHANISM

BACKGROUND OF THE INVENTION

This invention relates to printers and more particularly to a clutch mechanism for selectively coupling the platen shaft and driving mechanism to a driving power source and to index the shaft manually. Printers have a platen which is mounted rotatably on the printer frame and a driving source such as a stepping motor.

During normal printing, the platen is advanced line-by-line by the driving source.

During the manual indexing, the platen is advanced by hand, the platen and the driving source being disconnected.

Various attempts have been made to provide suitable platen clutch mechanisms for printers.

SUMMARY OF THE INVENTION

It is a main object of this invention to provide a platen clutch mechanism which is easy to operate.

It is another object of this invention to provide a platen clutch mechanism which is compact.

To this end, the present invention provides a platen clutch mechanism for automatic indexing and manual indexing comprising a shift having a plate fixed thereon. A knob is mounted on the shaft so as to be axially movable therealong. First clutch means is fixed on the shaft and has a hole therein to insert a projection. Second clutch means is mounted so as to be axially movable on the shaft and forced against the first clutch means. A drive gear is rotatably mounted on the shaft and engaged with the second clutch means.

BRIEF DESCRIPTION OF THE DRAWINGS

FIG. 4 is an exploded perspective view of certain elements thereof shown in FIG. 1 and FIG. 3.

DETAILED DESCRIPTION OF THE INVENTION

Figure 1:
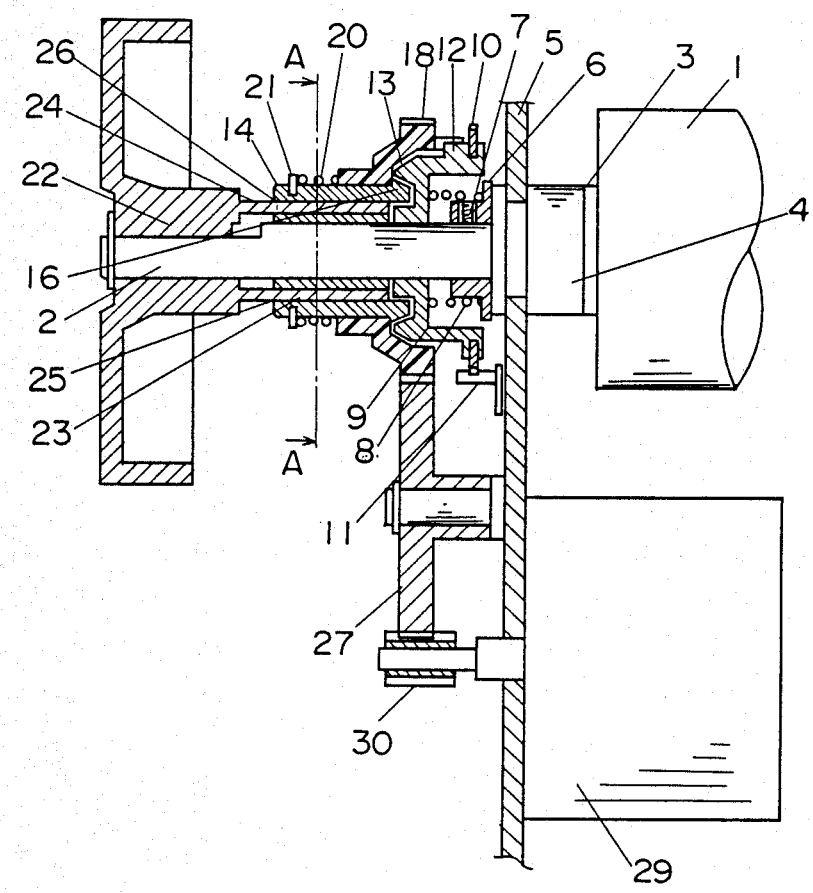
FIG. 1 is a cross sectional view of the mechanism of the invention, showing the clutch means in the engaged condition for driving the platen from the motor.
Figure 2:
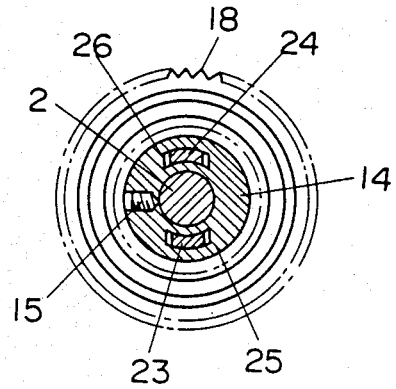
FIG. 2 is a cross sectional view of the mechanism of FIG. 1, taken on line A—A of FIG. 1.

Platen 1 has a shaft 2 on the center axis thereof. The shaft 2 has a washer 3 and a bearing 4 thereon. The bearing 4 is fixed on chassis 5.

Stop ring 6 is mounted on shaft 2 and has a set screw 7 securing the stop ring to the shaft 2 on the opposite side of chassis 5 so as to hold the platen axially with respect to the chassis.

Compression spring 8 is interposed between the stop ring 6 and a ratchet wheel 9 which is axially movable on the shaft 2.

Ratchet tooth member 10 is mounted fixedly on the ratchet wheel 9. The ratchet wheel is rotated discontinuously by the ratchet tooth member and a roller 11 forced against the ratchet tooth member.

The ratchet wheel 9 has a projection 12 on its peripheral surface and a clutch portion 13 on the end surfaces facing away from the plates.

Clutch member 14 is secured on the shaft 2 by set screw 15, and has a clutch portion 16 on the end facing toward the platen groove 17 on the peripheral surface of the other end (see FIG. 4).

Drive gear 18 is mounted rotatably on clutch member 14 and has a groove 19 in which the projection 12 engages.

Compression spring 20 is interposed between the driven gear 18 and stop ring 21 which is inserted in the groove 17 on clutch member 14.

A knob 22 is slidably mounted on the shaft 2 and has a pair of projections 23 and 24 which are inserted into a pair of through holes 25 and 26 in clutch member 14.

A spur gear 27 is rotatably mounted on chassis 5 and engages both driven gear 18 and drive gear 30 which is mounted on a shaft of a pulse motor 29.

The platen clutch mechanism having the above construction works as follows.

In normal operation, platen 1 is rotatably indexed line-by-line by pulse motor 29 with the parts in the positions as shown in FIG. 1.

Ratchet wheel 9 is forced away from platen 1 by spring 8 so as to engage the clutch portion 13 of ratchet wheel 9 and clutch portion 16 of clutch member 14.

Drive gear 30 and gear 27 transmit the rotational power of pulse motor 29 to driven gear 18.

The groove 19 in driven gear 18 has the projection of ratchet wheel 9 engaged therein, and accordingly drive gear 30 also rotates the ratchet wheel 9.

Figure 3:
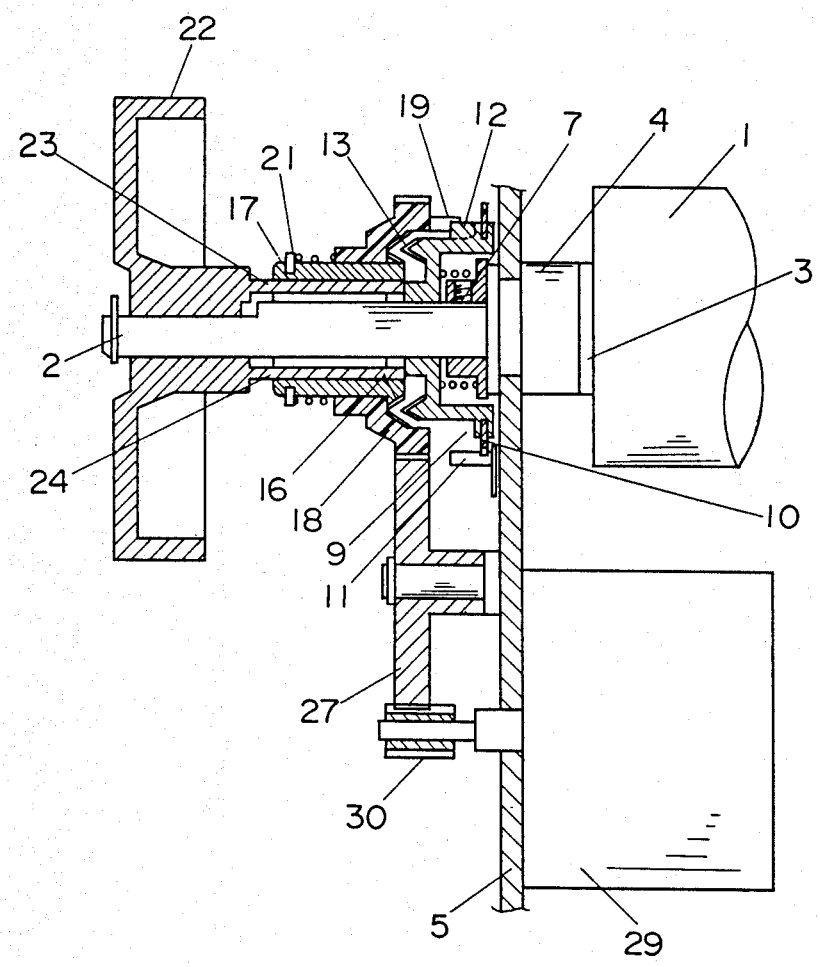
FIG. 3 is a cross sectional view of the mechanism of the invention, showing the clutch means in the disengaged condition for driving the platen by hand.

In the manual indexing operation, the knob 22 is moved inwardly, i.e. toward the platen, by hand, and platen 1 can be indexed by hand as shown in FIG. 3.

The pair of projections 23 and 24 on knob 22 push ratchet wheel 9 against the force of spring 8 and ratchet wheel 9 moves toward platen 1.

The clutch member 16 is disengaged from clutch portion 13 of ratchet wheel 9.

In this state, when the knob 22 is rotated by hand, the rotation is transferred to shaft 2 through clutch member 14 but is not transferred to driven gear 18 and ratchet wheel 9.

Although the preferred embodiment of the device has been described, it will be understood that within the purview of this invention various changes may be made in the form, details and arrangement of parts, the combination thereof, and mode of operation, which generally stated consist in a device capable of carrying out the objects set forth, as disclosed and defined in the appended claims.

I claim:

1. A platen clutch mechanism comprising:

a shaft having a platen fixedly mounted thereon;

a knob mounted on said shaft and axially movable therealong and having at least one projection thereon extending parallel to said shaft;

a first clutch member fixedly mounted on said shaft and having a through hole therein offset from said shaft and through which said projection slidably extends;

a second clutch member movably mounted on said shaft on the opposite side of said first clutch member from said knob for movement along said shaft and resiliently engaged in clutching engagement with said first clutch member and engagable by said projection for being moved out of clutching engagement with said first clutch member when said knob is moved toward said first clutch member;

a driven gear rotatably mounted around said first clutch member and means between said driven gear and said second clutch member for slidably and rotatably engaging said driven gear with said second clutch member, and means for normally holding said driven gear in a substantially fixed position along the axial length of said first clutch member; and drive gear means in a fixed position along the axial length of said first clutch member and engaged with said driven gear at said substantially fixed position;

whereby with said clutch members engaged, said platen can be driven through said driven gear, and when said knob is moved toward said first clutch member, only said second clutch member is moved to move away from said first clutch member to be disengaged therefrom, so that said platen can be moved by rotation of said knob and at the same time said driven gear remains in said substantially fixed position and does not move relative to said drive gear means.

2. A platen clutch mechanism as claimed in claim 1 in which there are two projections on said knob on diametrically opposite sides of said shaft, and two holes in said first clutch member slidably receiving said two projections.

* * * * *